United States Patent [19]

Kojima et al.

[11] Patent Number: 4,733,056

[45] Date of Patent: Mar. 22, 1988

[54] HEATER BACKED WITH A CERAMIC SUBSTRATE

[75] Inventors: Takao Kojima; Hiroyuki Ishiguro, both of Nagoya, Japan

[73] Assignee: NGK Spark Plug Co., Ltd., Nagoya, Japan

[21] Appl. No.: 896,863

[22] Filed: Aug. 15, 1986

[30] Foreign Application Priority Data

Aug. 23, 1985 [JP] Japan ..... 60-183846

[51] Int. Cl.[4] ..... H05B 3/16; H01C 1/012

[52] U.S. Cl. ..... 219/543; 219/270; 219/482; 219/485; 219/544; 219/546; 338/307; 338/308; 338/309; 338/310; 427/58; 427/101

[58] Field of Search ..... 219/270, 482, 485, 543, 219/544, 546; 338/307, 308, 310, 309, 312, 319; 427/58, 101

[56] References Cited

U.S. PATENT DOCUMENTS 4,357,526 11/1982 Yamamoto et al. ..... 219/544

4,464,646 8/1984 Burger et al. ..... 338/25

*Primary Examiner*—Clifford C. Shaw

*Assistant Examiner*—Gerald E. Preston

*Attorney, Agent, or Firm*—Wegner & Bretschneider

[57] ABSTRACT

A heater backed with a ceramic substrate having a ceramic substrate as a base plate and heating element formed thereon, which comprises a conductor for retaining ionized elements, said conductor branching from a terminal lead portion of the minus side connected to the heater element under an applied electric current and extending at the back side of the base plate, along the heating element pattern at least partly thereof. A protecting layer may be provided on the surface of said conductor. The conductor is connected with the lead portion through a conducting through hole.

5 Claims, 6 Drawing Figures

HEATER BACKED WITH A CERAMIC SUBSTRATE

BACKGROUND

The present invention relates to a heater backed with a ceramic substrate (hereinafter referred to as "ceramic plate heater"), especially a ceramic plate heater having an excellent durability.

Generally, a ceramic plate heater is produced, by thick film-printing on a ceramic substrate a heating element pattern using a paste containing heat resistant metal such as platinum, platinum-rhodium, molybdenum, tungsten, etc., and by cofiring the ceramic substrate with the printed pattern. In this case, the ceramic substrate is a ceramic material formable by conventional means, such as sheet forming and extrusion molding into a desired form such as plate, cylinder, etc. And in case of using this kind of ceramic plate heater in a D.C. electric source, as is the case with the exhaust gas sensor of automobiles, heat is generated by passing electric current under an applied D.C. voltage to the heating element. However, it had a drawback that the heating element has a short life due to disconnections which are easy to occur in a high temperature atmosphere such as an exhaust gas.

SUMMARY OF THE DISCLOSURE

It is a purpose of the present invention to overcome the above described drawback.

According to the investigation of the present invention, the principal cause of the disconnections resides in increase of local resistance and occurrence of voids. One of the causes resides in that easily ionizable elements in a heating element or a ceramic substrate migrate toward a low electric potential side owing to a D.C. field at a high temperature to produce a local high concentration, and the ionized elements which migrated have difficulty in migrating at the low temperature portion on the low potential side thus to be accumulated as oxides and/or carbides. As a result, disconnections sometimes occurred owing to the increase or accumulation of the calorific value accompanied by the increase of resistance and local overheating in this portion.

The present invention provides the possibility of preventing the disconnection without the migration of ionized elements in case of an applying D.C. voltage to heating elements, by preparing a conductor having an equal or inferior electric potential to that of the end portion of the low potential side of the above heating element (this conductor is hereinafter referred to "conductor for retaining ionized elements"), said conductor being branched from the terminal-lead portion of the minus side under an applied electric current, and being extended at the back side of heater substrate, along the above heat element pattern at least partly thereof in a ceramic plate heater having the heating element on the ceramic substrate as a base plate.

a: the position of the migration occurrence in the absence of a conductor of retaining ionized elements.

a': the position of frequent occurrence of the migration in the presence of a conductor for retaining ionized elements.

DESCRIPTION OF THE PREFERRED EMBODIMENTS

Figure 1:
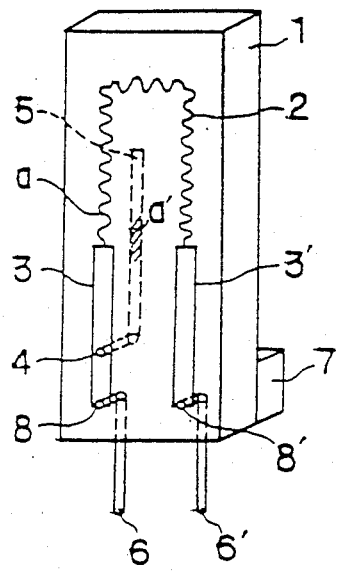
FIG. 1 shows a perspective view of an intermediate product of a ceramic plate heater.

The present invention is explained in accordance with the Drawings. FIG. 1 is a perspective view of an intermediate product of a ceramic heater in the present invention.

Figure 2:
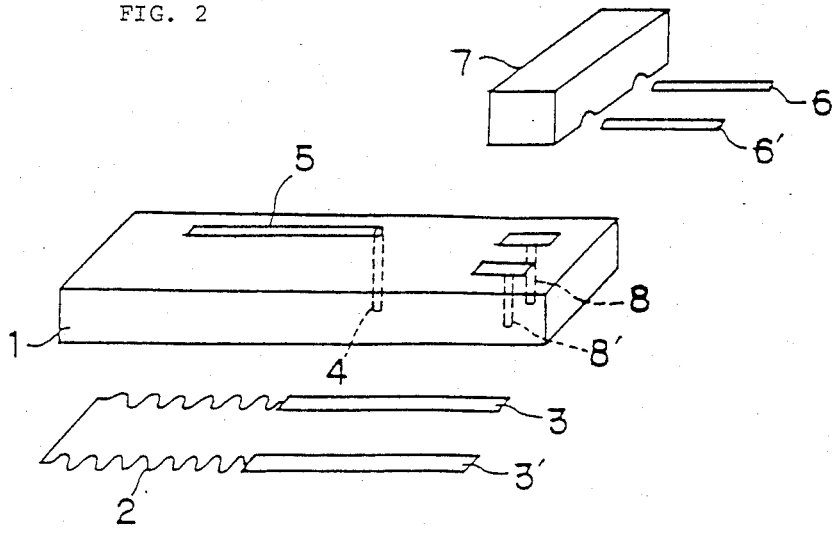
FIG. 2 shows a schematic view thereof.

FIG. 2 is a schematic view thereof. At first, the negative pole of a D.C. source is connected with the side (the lead portion 3) which is connected with a conductor 5 for retaining ionized elements among the lead portions 3 and 3', and the positive pole is connected with the other lead portion 3'. Then, when a D.C. voltage is applied between these lead portions 3 and 3', a heating element 2 generates heat through electronic conduction. In this case, the ionized elements do not migrate toward the low electric potential side through the heating element, since the conductor 5 for retaining ionized elements is provided on the back side of the ceramic substrate, the provision of which is different from the conventional ceramic heaters. That is, since the conductor 5 for retaining ionized element is connected with the lead portion 3 of the negative terminal side, this conductor 5 has a lower electric potential than any other portion of the heating element 2. Hence, the conductor 5 for retaining ionized element prevents positively charged ionized elements from migrating toward the lower electic potential side through the heating element 2 under an applied D.C. voltage.

Figure 3:
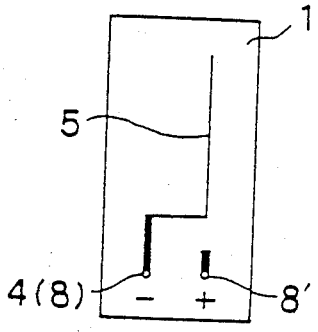
FIGS. 3–6 show the examples of pattern forms of a conductor for retaining ionized elements.
Figure 4:
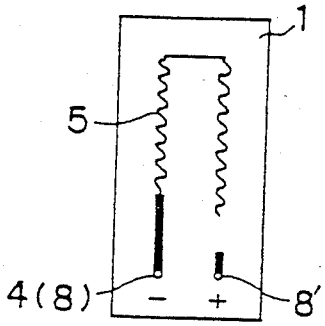
Figure 5:
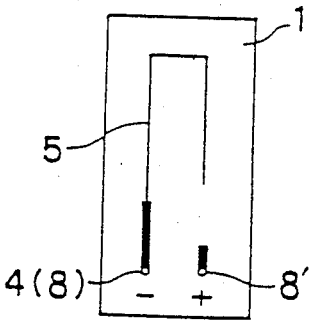

In this case, it is not required to provide the conductor 5 for retaining ionized element at the right back position on the opposite surface of the heating element 2, nor to provide it along the entire pattern of the heating element 2. FIGS. 3–5 show examples of the configuration of the conductor 5 for retaining ionized elements. Further, a protecting layer can be provided on the surface of the conductor 5.

Reference numeral 1 designates a green sheet. The main ingredients of the green sheet 1 are alumina, mullite, cordierite, forsterite, beryllia, silicon nitride, etc. The heating element 2, the main ingredients of which are metal powder having a high melting point such as tungsten, molybdenum, tantalum, platinum, rhodium, etc., is thick film-printed on the surface of the green sheet 1, in paste-form optionally by adding thereto ceramic powder with the quality equal to or different from that of the green sheet 1 for the adjustment of resistance. The lead portions 3 and 3' connect electrically the heating element 2 with the D.C. electric source, consist of the same material as the heating element 2, and are simultaneously or separately thick film-printed in the same manner as the heating element 2. However, the lead portions 3 and 3' are kept wider than heating element 2, which decreases a undesired heat generation in these portions. Reference numeral 4 represents a through hole provided at the lead portion of the negative terminal under the applied current. The conductor 5 for retaining ionized elements is of the same material as the heating element 2 and is simultaneously or separately thick film-printed in the same manner as the heating element 2, so that one end (portion) may be electrically connected with the lead portion 3. Reference numerals 6 and 6' are platinum wires for the connection with the electric source, and a ceramic green sheet 7 is used for fixing the platinum wires 6 and 6'.

Through holes 8 and 8' connect the lead portions 3 and 3' with the platinum wires 6 and 6', wherein either one of the through holes 4 and 8 can be utilized in dual purposes.

Thus, the green sheet 1, on the surface of which the heating element 2, the lead portions 3 and 3' and the conductor 5 for retaining ionized elements have been printed, produces a ceramic plate heater even by firing as such, but it is desirable to press laminate one more green sheet on the printed surface or to coat and fire an insurating paste thereon, in order to protect the printed wires. The final shape of a ceramic plate heater may be a planar plate form or a tube form obtained by winding a green sheet around a suitable cylinder core body with subsequent firing. It is essential that a required printed pattern should be present after the firing. Accordingly, there is produced a ceramic plate heater for an applied D.C. voltage of the present invention.

The present invention will be explained by reference to the following examples; however, these examples are intended to illustrate the present invention and are not be construed to limit the scope of the present invention.

EXAMPLES 1. 92 weight % of $Al_2O_3$ (90% of $Al_2O_3$ is smaller than 2.5 um), 3 weight % of MgO (99% of MgO is smaller than 2.5 um) and a small amount of CaO and $SiO_2$ were weighed and mixed.

2. Toluene and methyl ethyl ketone were added and mixed therewith for 10 hours by $Al_2O_3$ balls.

3. Organic binder such as polyvinyl butyral was added thereto and mixed for 20 hours.

4. Green sheets each having 0.8 mm and 0.3 mm thickness (green size) were produced by the Doctor Blade Method.

5. The sheets obtained in the step 4 were cut into a side of 60 mm×90 mm.

6. Pt of 25 μm thickness was screen-printed on the sheet of 0.8 mm thickness obtained in the step 5 to produce a heater and lead portions.

7. A through hole of a 0.5 mm diameter was opened at the lowest part of the heater lead portion, and was filled with Pt-solution by using a needle and a brush.

8. A small amount of slurry obtained in the step 2 was taken and dried. Then, a paste was produced by adding butyl carbitol thereto.

9. The paste obtained in the step 8 was screen-printed on the sheet after the step 6 in 50 μm thickness (green size).

10. The paste obtained in the step 8 was screen-printed on the reverse side of the printed surface (maintained in the same upright posture, i.e., it was not turned upside down) in 0.3 mm width and about 20 μm thickness, as shown in FIGS. 3–6 to produce the conductor for retaining ionized elements and the lead portions.

11. Platinum wire was placed on the lead portion on the surface of the step 10, and the sheet of a 0.3 mm thickness (green size) obtained in the step 5 was laminated thereon.

12. After removing resin at 250° C. for 6 hours, the product of the step 11 was fired at 1520° C. for 4 hours in a normal atmosphere.

13. Nickel wire was welded to the platinum wire by using the resistance welding method to produce a heater.

14. The heater of comparative example was obtained in the same manner as the above steps, except the absence of the step 10 for producing the conductor for retaining ionized elements. A D.C. voltage (15 V) was applied to the heaters of examples and the comparative example obtained in the above manner, and the migration at the pattern portion of the heating elements was observed and shown in Table 1.

As seen in Table 1, the heater of the present invention is difficult to induce the migration. Further, as a reference test, when an electric current was applied to the specimen No. 2, reversing + and −, disconnection of wire occurred.

TABLE 1

Figure 6:
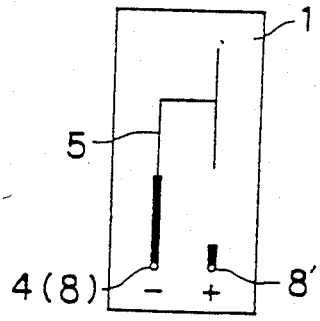

| Specimen No. | Form of a conductor for retaining ionized elements | Initial resistance value | After 20 hours Resistance value (Ω) | After 20 hours Migration | After 10 hours Resistance value (Ω) | After 10 hours Migration |
|---|---|---|---|---|---|---|
| 1 | FIG. 3 | 2.5 | 2.7 | none | 2.6 | none |
| 2 | FIG. 4 | 2.4 | 2.6 | none | 2.7 | none |
| 3 | FIG. 5 | 2.5 | 2.6 | none | 2.6 | none |
| 4 | FIG. 6 | 2.6 | 2.7 | none | 2.7 | none |
| Comparative Ex. | — | 2.5 | 3.0 | Migration | 3.2 | Migration |

It should be noted that modification may be made without departing from the gist of the present invention as herein disclosed and claimed below.

What is claimed is:

1. A heater backed with a ceramic substrate having a ceramic substrate as a base plate and heating element formed thereon, which comprises a conductor for retaining ionized elements, said conductor branching from a terminal lead portion of the minus side connected to the heater element under an applied electric current and extending at the back side of the base plate, along the heating element pattern at least partly thereof.

2. A heater backed with a ceramic substrate according to claim 1, wherein a protecting layer is provided on the surface of said conductor.

3. A heater backed with a ceramic substrate according to claim 1, wherein said conductor is connected with the lead portion through a conducting through hole.

4. A heater backed with a ceramic substrate according to claim 1, wherein the conductor extends substantially parallel with the heating element.

5. A heater backed with a ceramic substrate according to claim 4, wherein the conductor extends at least on the back portion which corresonds to the connecting point between the heating element and the lead portion.

* * * * *